US011376714B2

(12) United States Patent
Zhang et al.

(10) Patent No.: US 11,376,714 B2
(45) Date of Patent: Jul. 5, 2022

(54) FAUCET INSTALLATION TOOL

(71) Applicant: Xiamen Forbetter Sanitary Ware Co., Ltd., Fujian (CN)

(72) Inventors: Xingui Zhang, Xiamen (CN); Wei Liu, Xiamen (CN); Mouyong Lin, Xiamen (CN)

(73) Assignee: XIAMEN FORBETTER SANITARY WARE CO., LTD., Fujian (CN)

( * ) Notice: Subject to any disclaimer, the term of this patent is extended or adjusted under 35 U.S.C. 154(b) by 36 days.

(21) Appl. No.: 17/017,700

(22) Filed: Sep. 11, 2020

(65) Prior Publication Data

US 2022/0080558 A1 Mar. 17, 2022

(51) Int. Cl.
*B25B 13/06* (2006.01)
*B25B 23/00* (2006.01)

(52) U.S. Cl.
CPC ..... *B25B 13/06* (2013.01); *B25B 23/0035* (2013.01)

(58) Field of Classification Search
CPC ..... B25B 13/16; B25B 23/0035; B24B 27/14
USPC ..... 81/121.1, 124.6, 124.5
See application file for complete search history.

(56) References Cited

U.S. PATENT DOCUMENTS 5,048,378 A * 9/1991 Nikolas ..... B25B 13/06 81/124.2
5,996,447 A * 12/1999 Bayouth ..... B25B 13/06 81/121.1
2005/0051003 A1* 3/2005 Stern ..... H01R 43/26 81/176.3
2008/0034927 A1* 2/2008 Adkins ..... B25B 13/481 81/176.15
2008/0066584 A1* 3/2008 Vines ..... B25B 13/48 81/124.2

FOREIGN PATENT DOCUMENTS

WO WO-2015106982 A1 * 7/2015 ..... B25B 13/06

OTHER PUBLICATIONS

"Buckle," Merriam-Webster <https://www.merriam-webster.com/> Retrieved from <https://www.merriam-webster.com/dictionary/buckle> on Dec. 8, 2021) (Year: 2021).*

* cited by examiner

*Primary Examiner* — David B. Thomas
*Assistant Examiner* — Jonathan G Santiago Martinez
(74) *Attorney, Agent, or Firm* — Leong C. Lei

(57) ABSTRACT

A faucet installation tool includes at least two coupling units. Every adjacent two of the coupling units are detachably connected together. A hollow area is formed between middle portions of the coupling units. Tops of the coupling units are formed with a first socket portion. The first socket portion is configured to receive a lock nut used for installing and fixing a threaded connecting pipe of a faucet, improving the connection strength between the first socket portion and the lock nut. The faucet installation tool does not require a large lateral space and is convenient to tighten the lock nut when in use.

10 Claims, 9 Drawing Sheets

FAUCET INSTALLATION TOOL

BACKGROUND OF THE INVENTION

1. Field of the Invention

The present invention relates to an installation tool, and more particularly to a faucet installation tool.

2. Description of the Prior Art

In general, the faucet of a wash basin is equipped with a threaded connecting pipe under the countertop. A water inlet hose is connected to the threaded connecting pipe. The water inlet hose is usually provided with a lock nut. The user often uses a wrench to tighten the lock nut. The lock nut is tightly screwed to the threaded connecting pipe, so that the faucet can be firmly fixed to the countertop. If the user uses an ordinary wrench to tighten the lock nut, a large lateral space is required. However, the space under the countertop is small, and it is inconvenient to use the wrench. If the user uses an open-ended wrench to tighten the lock nut, although it can be used in the space under the countertop, the connection strength between the open-ended wrench and the lock nut is not strong enough to tighten the lock nut.

Accordingly, the inventor of the present invention has devoted himself based on his many years of practical experiences to solve these problems.

SUMMARY OF THE INVENTION

The primary object of the present invention is to provide a faucet installation tool that is easy to use and easy to tighten a lock nut.

In order to achieve the above object, the present invention adopts the following solutions.

A faucet installation tool comprises at least two coupling units. Every adjacent two of the coupling units are detachably connected together. A hollow area is formed between middle portions of the coupling units. Tops of the coupling units are formed with a first socket portion. The first socket portion is configured to receive a lock nut used for installing and fixing a threaded connecting pipe of a faucet.

Preferably, bottoms of the coupling units are formed with a second socket portion.

Preferably, the second socket portion has an internal diameter less than that of the first socket portion.

Preferably, the faucet installation tool further comprises an auxiliary rotating rod extending out of outer side walls of the coupling units.

Preferably, the auxiliary rotating rod is a screwdriver, and the coupling units are provided with perforations for the screwdriver to pass through.

Preferably, the perforations are arranged at lower ends of the coupling units.

Preferably, every adjacent two of the coupling units are connected by a buckle assembly.

Preferably, one coupling unit of every adjacent two of the coupling units is provided with an engaging portion. The other coupling unit of every adjacent two of the coupling units is provided with an engaging groove. The engaging portion is engaged in the engaging groove.

Preferably, one coupling unit of every adjacent two of the coupling units is provided with a connecting block. An upper end of the connecting block is formed with a notch. The engaging portion is protruded on an inner wall of the notch of the connecting block. The other coupling unit of every adjacent two of the coupling units is provided with an engaging block. The engaging groove is formed on one side of the engaging block. The engaging block is engaged in the notch.

Preferably, the tops of the coupling units are formed with a plurality of spaced engaging notches. A side wall of the lock nut is provided with a plurality of protrusions. The protrusions are engaged in the corresponding engaging notches.

Preferably, the number of the coupling units is two.

Preferably, the middle portions of the coupling units are provided with reduced sections.

Preferably, the reduced sections are provided with transverse ribs and vertical ribs intersecting the transverse ribs.

After adopting the above technical solution, in the present invention, every adjacent two of the coupling units are detachably connected, and the hollow area is formed between the middle portions of the coupling units. When the lock nut needs to be tightened, the lock nut is screwed to the threaded connecting pipe of the faucet from the water inlet hose of the faucet. The coupling units are connected together, so that the first socket portion surrounded by the tops of the coupling units is just sleeved onto the outside of the lock nut, thereby improving the connection strength between the first socket portion and the lock nut. Then, the user holds and rotates the coupling units, so that the lock nut is gradually screwed upward along the threaded connecting pipe until the faucet is firmly fixed to the countertop. After that, the coupling units are detached from the lock nut. Therefore, the present invention does not require a large lateral space, and it is convenient to tighten the lock nut when in use.

DETAILED DESCRIPTION OF THE PREFERRED EMBODIMENTS

Figure 1:
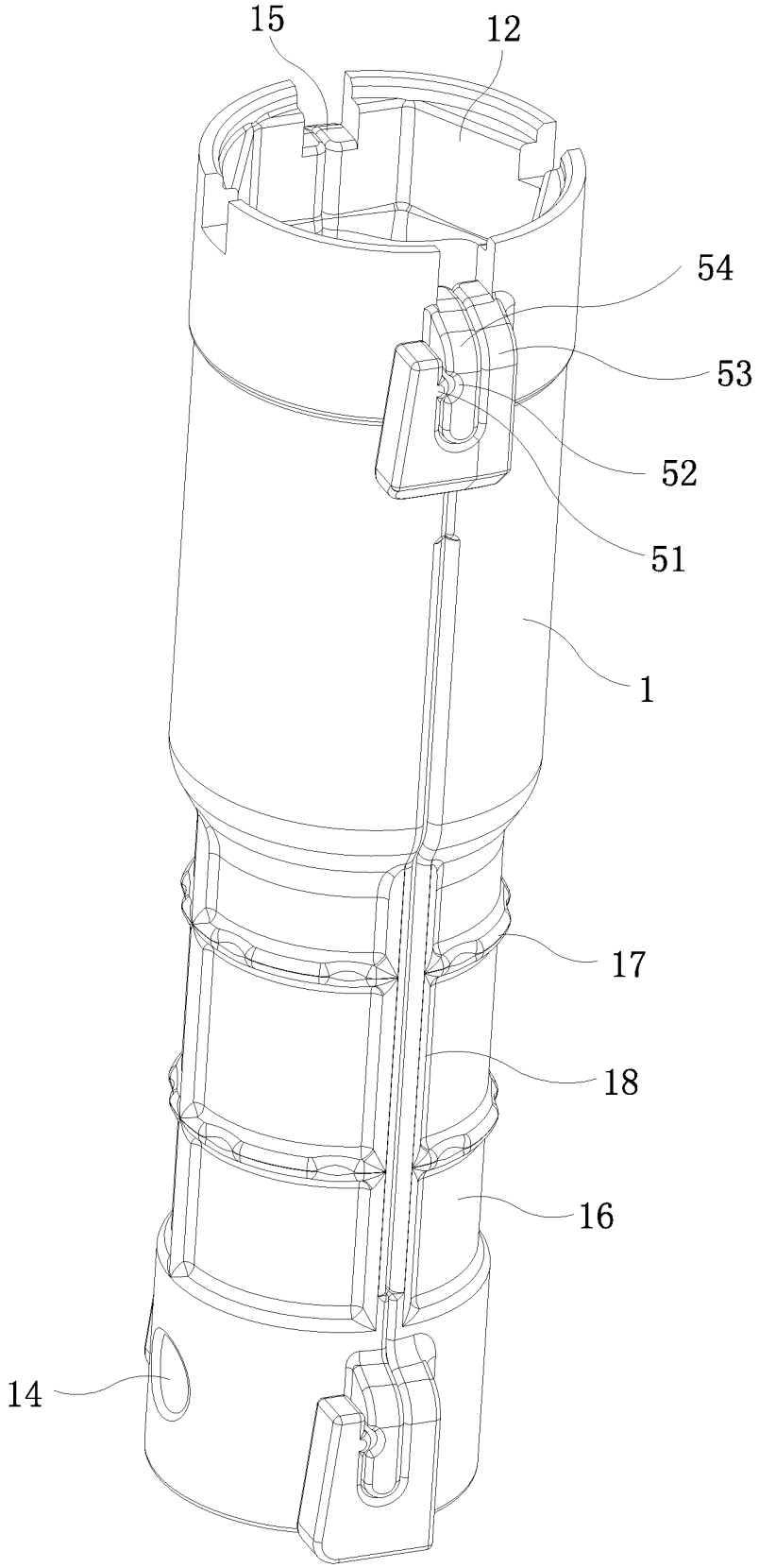
FIG. 1 is a first perspective view of the present invention.
Figure 2:
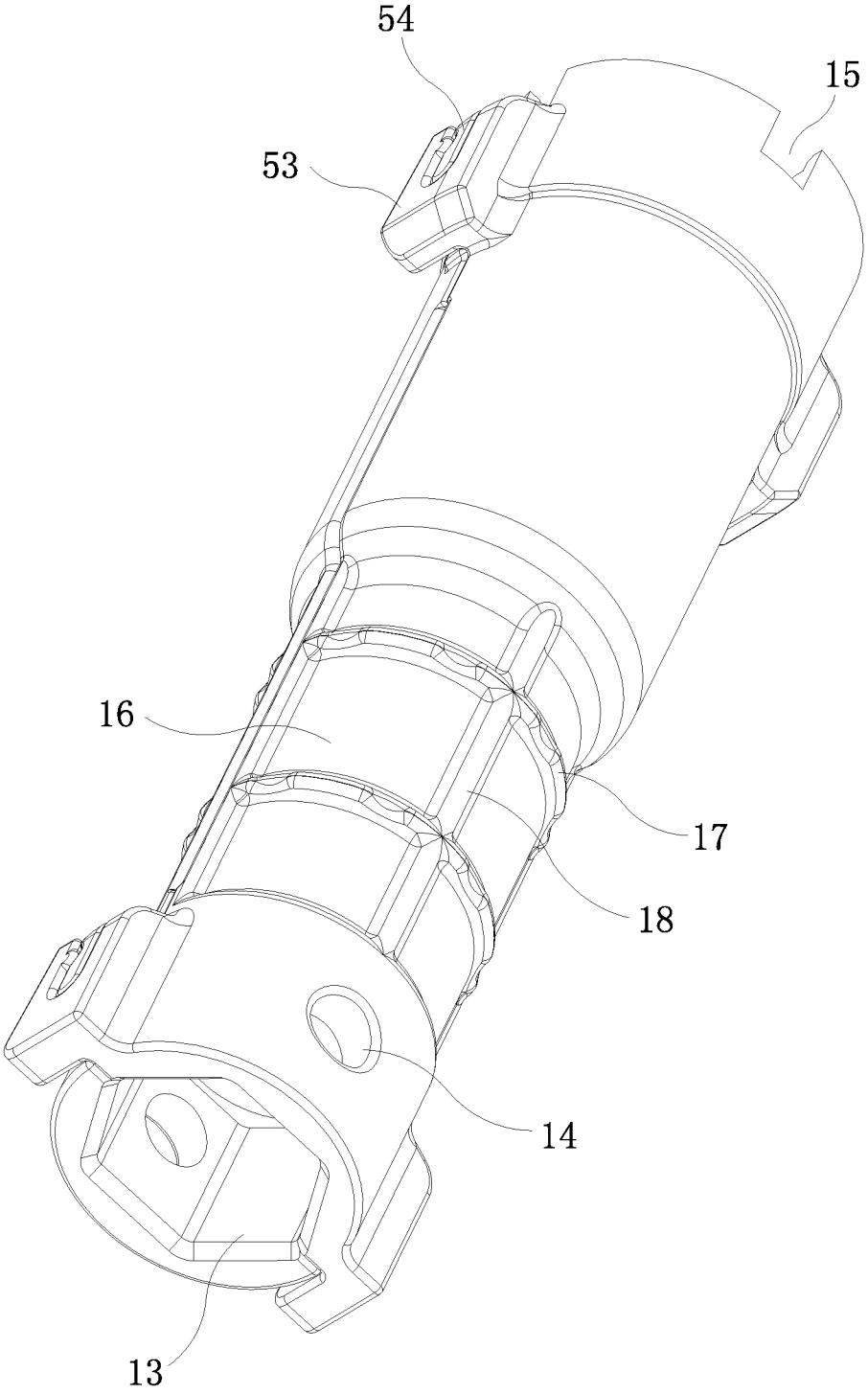
FIG. 2 is a second perspective view of the present invention.

Embodiments of the present invention will now be described, by way of example only, with reference to the accompanying drawings.

As shown in FIG. 1 through FIG. 9, the present invention discloses a faucet installation tool. The faucet installation tool comprises at least two coupling units 1. Every adjacent two of the coupling units 1 are detachably connected together. A hollow area 11 is formed between the middle portions of the coupling units 1. The tops of the coupling units 1 are formed with a first socket portion 12. The first socket portion 12 is configured to receive a lock nut 3 used for installing and fixing a threaded connecting pipe 22 of a faucet 2. In the embodiment shown in the figure, the number of the coupling units 1 is two for illustration, but it is not limited to this. When the number of the coupling units 1 is two, it is convenient to process and assemble.

Figure 3:
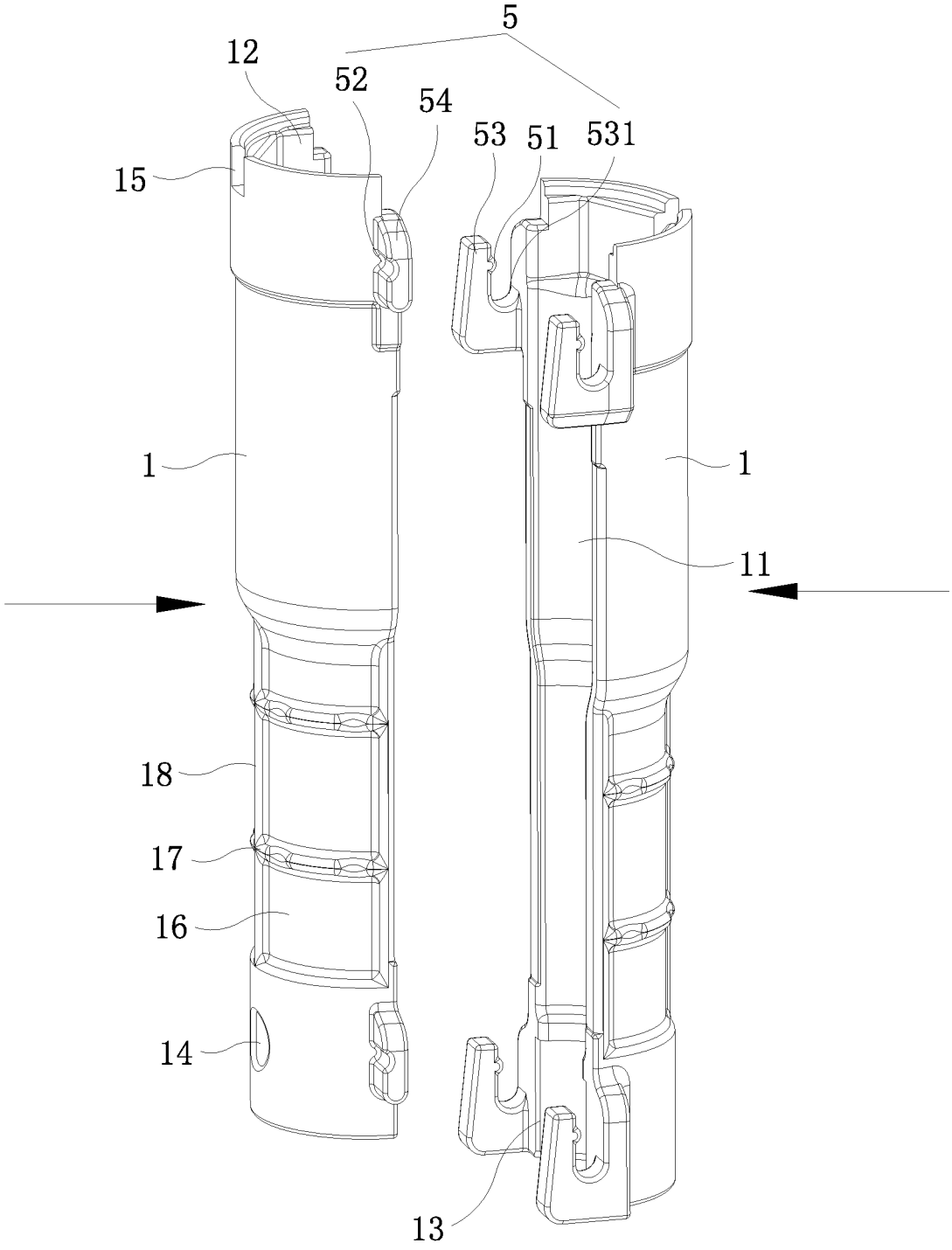
FIG. 3 is a first assembled schematic view of the present invention, wherein the arrow direction in the figure indicates the assembly direction of the present invention.
Figure 4:
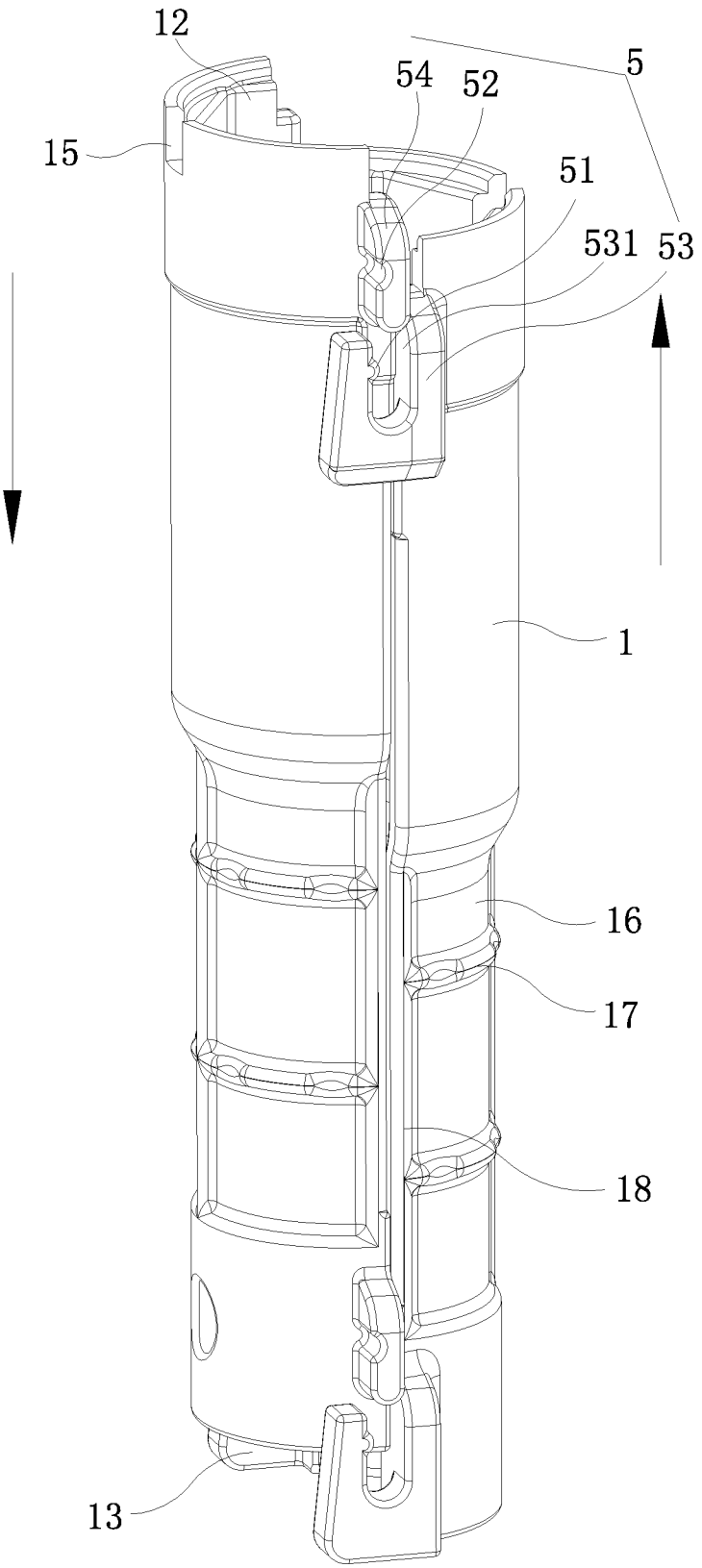
FIG. 4 is a second assembled schematic view of the present invention.
Figure 5:
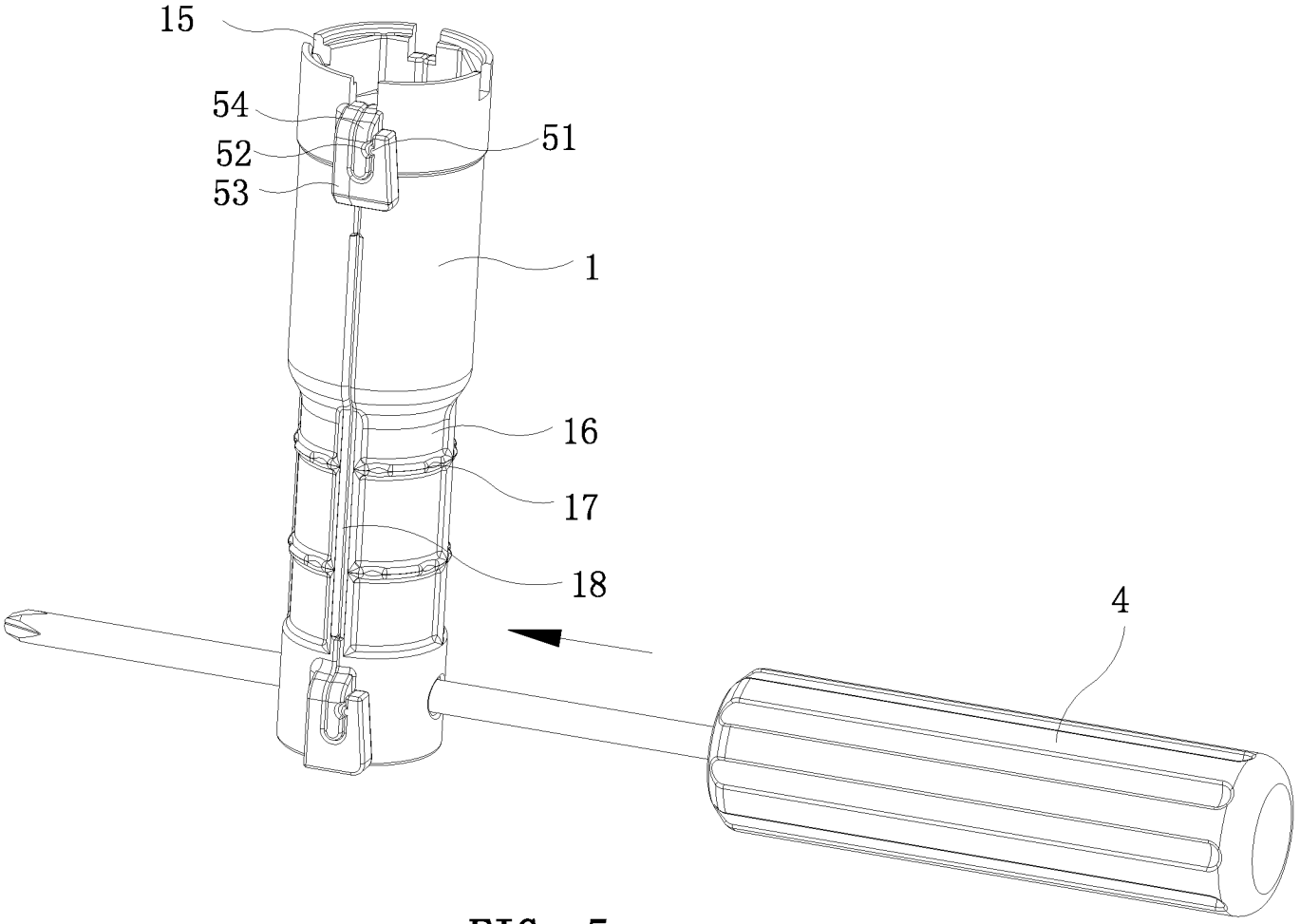
FIG. 5 is a schematic view of the present invention in a use state.
Figure 6:
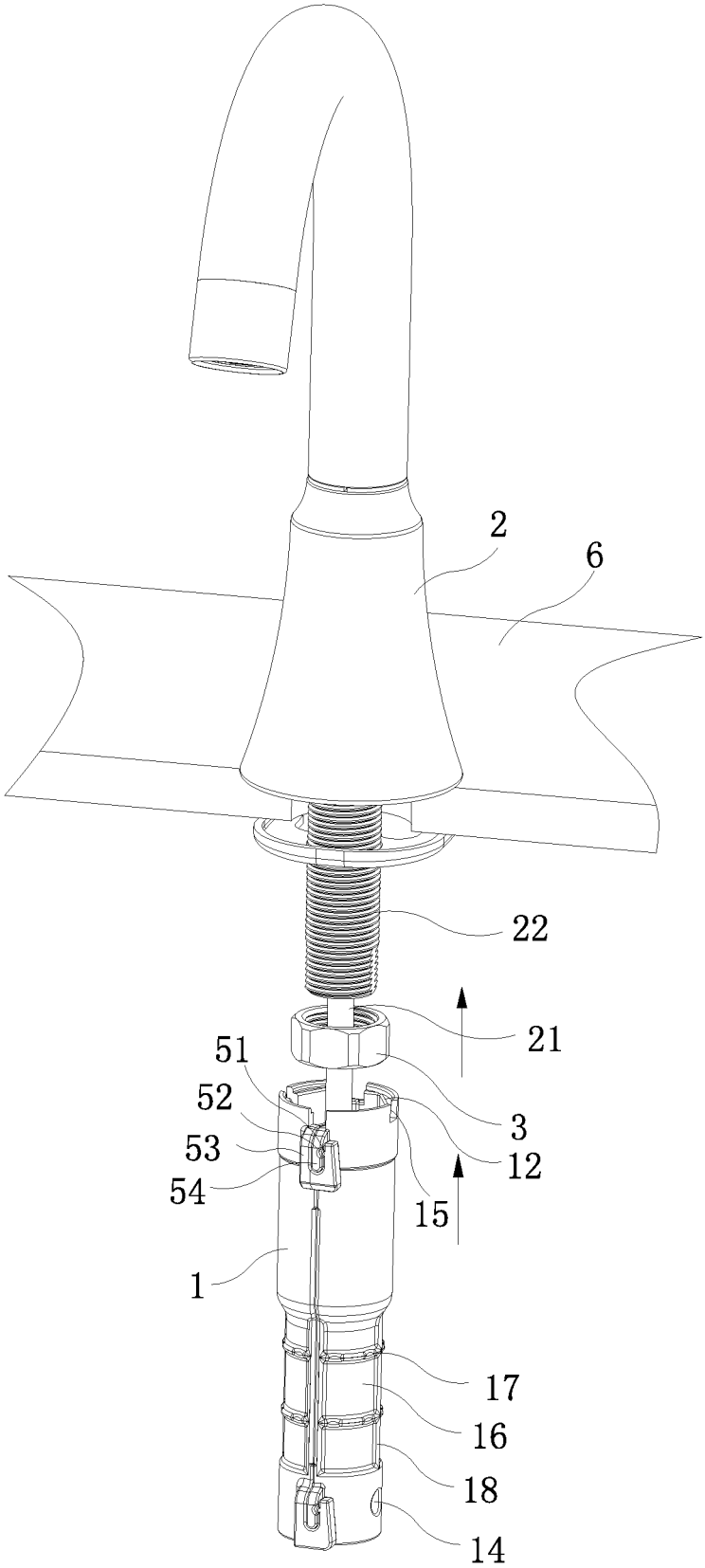
FIG. 6 is a first schematic view of the use of the present invention, wherein the arrow direction in the figure indicates the direction of tightening the lock nut.
Figure 7:
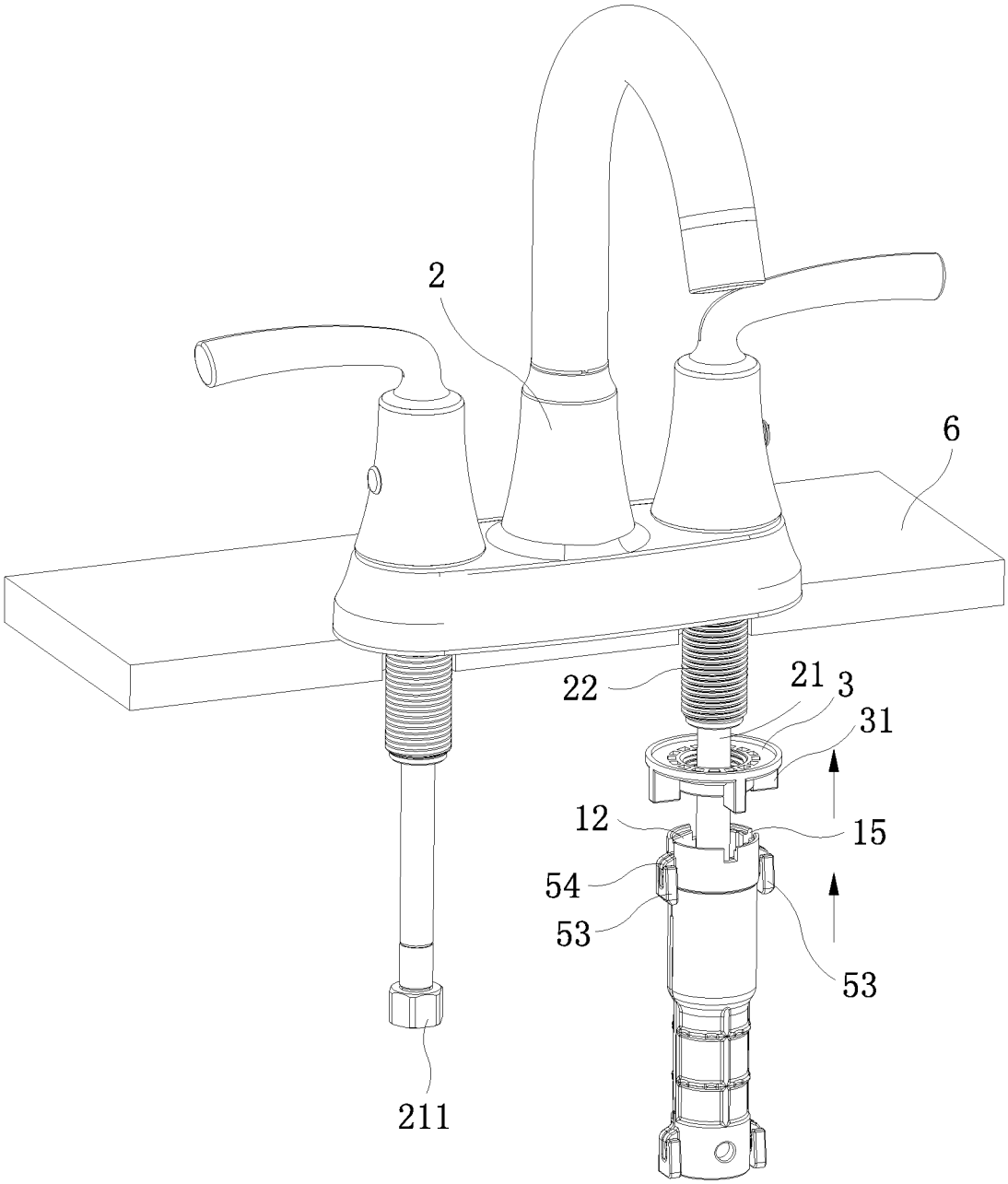
FIG. 7 is a second schematic view of the use of the present invention, wherein the arrow direction in the figure indicates the direction of tightening the lock nut.
Figure 8:
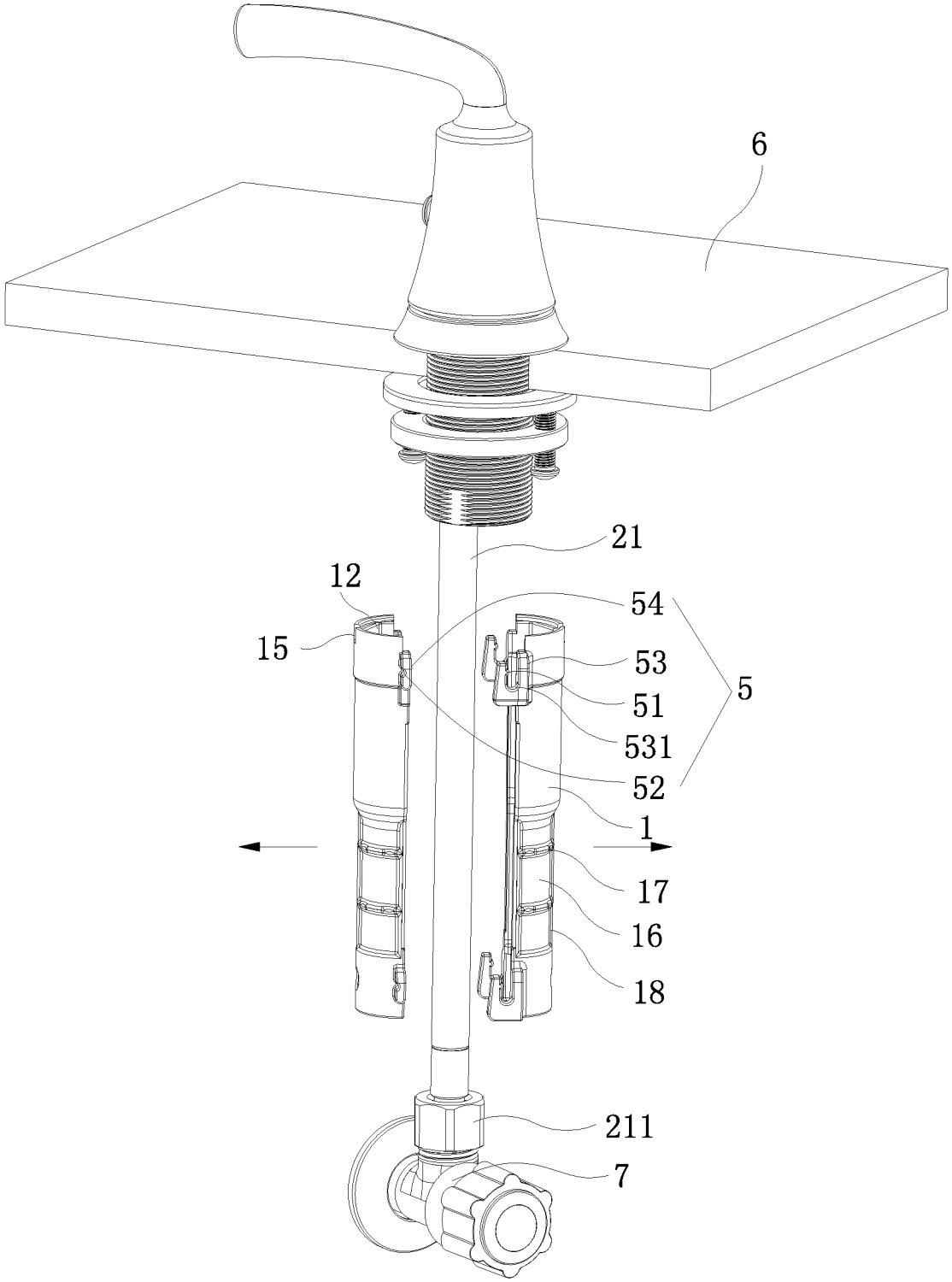
FIG. 8 is a third schematic view of the use of the present invention, wherein the arrow direction in the figure indicates the detachment direction of the present invention.
Figure 9:
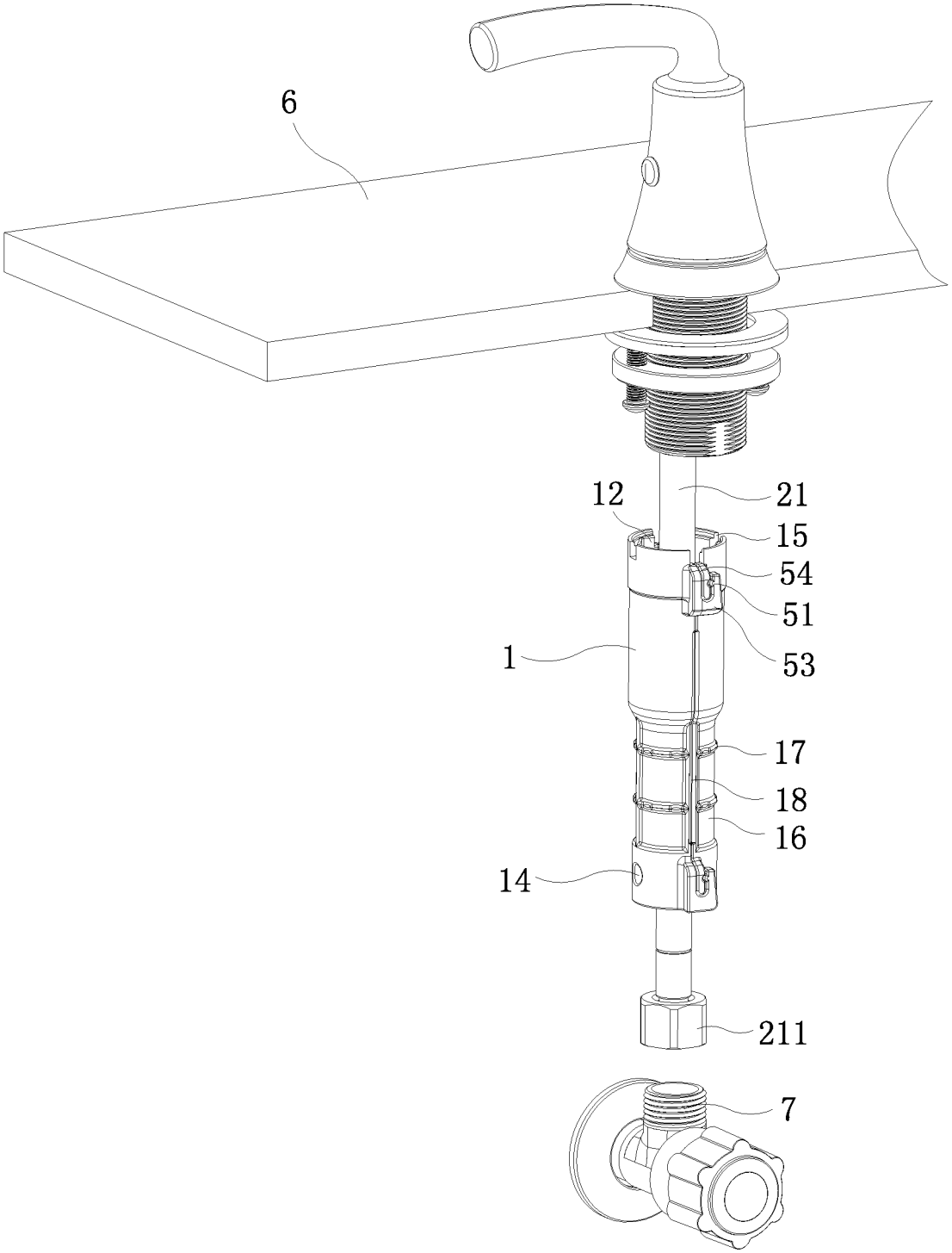
FIG. 9 is a fourth schematic view of the use of the present invention.

Because every adjacent two of the coupling units 1 are detachably connected, the hollow area 11 is formed between the middle portions of the coupling units 1. The hollow area 11 is configured to receive the threaded connecting pipe 22 and a water inlet hose 21. As shown in FIG. 6 and FIG. 7, when the lock nut 3 needs to be tightened, the lock nut 3 is screwed to the threaded connecting pipe 22 of the faucet 2 from the water inlet hose 21 of the faucet 2. As shown in FIG. 3 and FIG. 4, the coupling units 1 are connected together, so that the first socket portion 12 surrounded by the tops of the coupling units 1 is just sleeved on the outside of the lock nut 3, thereby improving the connection strength between the first socket portion 12 and the lock nut 3. Then, the user holds and rotates the coupling units 1, so that the lock nut 3 is gradually screwed upward along the threaded connecting pipe 22 until the faucet 2 is firmly fixed to the countertop 6. After that, the coupling units 1 are detached from the lock nut. Therefore, the present invention does not require a large lateral space, and it is convenient to tighten the lock nut 3 when in use.

Further, bottoms of the coupling units 1 are formed with a second socket portion 13.

The internal diameter of the second socket portion 13 may be less than the internal diameter of the first socket portion 12. The second socket portion 13 can be used to fit and tighten the lock nut 3 with a small outer diameter, and the first socket portion 12 can be used to fit and tighten the lock nut 3 with a large outer diameter, thereby improving the applicability of the present invention.

The bottom end of the water inlet hose 21 may be provided with a mounting nut 211, so that the mounting nut 211 can be screwed to a water outlet 7 of the wall. Please refer to FIG. 8 and FIG. 9. After the faucet 2 is installed, it is not necessary to use the faucet installation tool of the present invention. The coupling units 1 can be connected together to be sleeved on the water inlet hose 21, so that the faucet installation tool of the present invention won't be lost. The coupling units of the present invention are detachably connected together, which can overcome the problem that the existing open-ended wrench cannot pass the mounting nut 211 because the mounting nut 211 is too big.

Further, the present invention may include an auxiliary rotating rod extending out of the outer side walls of the coupling units 1. The auxiliary rotating rod is configured to increase the torque, so that the action of tightening the lock nut 3 is more labor-saving.

The auxiliary rotating rod may be a screwdriver 4, but it is not limited to this. The coupling units 1 are provided with perforations 14 for the screwdriver 4 to pass through, thereby improving the flexibility of use of the present invention. The user can choose to use or not to use the screwdriver 4 for tightening the lock nut 3.

In addition, the perforations 14 may be arranged at the lower ends of the coupling units 1 to further increase the torque.

In the embodiment shown in the figure, every adjacent two of the coupling units 1 are connected by a buckle assembly 5, but not limited thereto. The number of the buckle assemblies 5 between every adjacent two of the coupling units 1 is two. The upper and lower buckle assemblies 5 are spaced, thereby improving the connection between the coupling units 1.

Furthermore, one coupling unit 1 of every adjacent two of the coupling units 1 is provided with an engaging portion 51, and the other coupling unit 1 of every adjacent two of the coupling units 1 is provided with an engaging groove 52. The engaging portion 51 is engaged in the engaging groove 52, so that the coupling units 1 can be assembled and disassembled quickly, but not limited thereto. The number of the engaging portions 51 and the engaging grooves 52 of every adjacent two of the coupling units 1 is shown as an example in the figure.

Furthermore, one coupling unit 1 of every adjacent two of the coupling units 1 is provided with a connecting block 53. The upper end of the connecting block 53 is formed with a notch 531. The engaging portion 51 is protruded on the inner wall of the notch 531 of the connecting block 53. The other coupling unit 1 of every adjacent two of the coupling units 1 is provided with an engaging block 54. The engaging groove 52 is formed on one side of the engaging block 54. The engaging block 54 is engaged in the notch 531. The setting of the engaging block 54 and the connecting block 53 can improve the connection between the coupling units 1. The number of the connecting blocks 53 and the engaging blocks 54 of every adjacent two of the coupling units 1 is shown as an example in the figure.

Furthermore, the tops of the coupling units 1 are formed with a plurality of spaced engaging notches 15. The side wall of the lock nut 3 is provided with a plurality of protrusions 31. The protrusions 31 are engaged in the corresponding engaging notches 15, which is beneficial for the coupling units 1 to rotate and tighten the lock nut 3.

Further, the middle portions of the coupling units 1 may be provided with reduced sections 16 so as to facilitate the user to hold the faucet installation tool of the present invention. The reduced sections 16 may be provided with transverse ribs 17 and vertical ribs 18 intersecting the transverse ribs 17. The numbers of the horizontal ribs 17 and the vertical ribs 18 are at least two, but not limited thereto. This is beneficial for the user to hold and rotate the coupling units 1 so as to tighten the lock nut 3.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A faucet installation tool, comprising at least two coupling units, every adjacent two of the coupling units being detachably connected together, a hollow area being formed between middle portions of the coupling units, tops of the coupling units being formed with a first socket portion, the first socket portion being configured to receive a lock nut used for installing and fixing a threaded connecting pipe of a faucet; wherein every adjacent two of the coupling units are connected by a buckle assembly; wherein one coupling unit of every adjacent two of the coupling units is provided with an engaging portion, the other coupling unit of every adjacent two of the coupling units is provided with an engaging groove, and the engaging portion is engaged in the engaging groove, wherein one coupling unit of every adjacent two of the coupling units is provided with a connecting block, an upper end of the connecting block is formed with a notch, the engaging portion is protruded on an inner wall of the notch of the connecting block, the other coupling unit of every adjacent two of the coupling units is provided with an engaging block, the engaging groove is formed on one side of the engaging block, and the engaging block is engaged in the notch.

2. The faucet installation tool as claimed in claim 1, wherein bottoms of the coupling units are formed with a second socket portion.

3. The faucet installation tool as claimed in claim 2, wherein the second socket portion has an internal diameter less than that of the first socket portion.

4. The faucet installation tool as claimed in claim 1, further comprising an auxiliary rotating rod extending out of outer side walls of the coupling units.

5. The faucet installation tool as claimed in claim 4, wherein the auxiliary rotating rod is a screwdriver, and the coupling units are provided with perforations for the screwdriver to pass through.

6. The faucet installation tool as claimed in claim 5, wherein the perforations are arranged at lower ends of the coupling units.

7. The faucet installation tool as claimed in claim 1, wherein the tops of the coupling units are formed with a plurality of spaced engaging notches, the spaced engaging notches configured to engage a plurality of corresponding protrusions provided in a side wall of the lock nut.

8. The faucet installation tool as claimed in claim 1, wherein the number of the coupling units is two.

9. The faucet installation tool as claimed in claim 1, wherein the middle portions of the coupling units are provided with reduced sections.

10. The faucet installation tool as claimed in claim 9, wherein the reduced sections are provided with transverse ribs and vertical ribs intersecting the transverse ribs.

* * * * *